US008011051B1

(12) United States Patent
Ba-Akeel et al.

(10) Patent No.: US 8,011,051 B1
(45) Date of Patent: Sep. 6, 2011

(54) TOILET BOWL CLEANING ASSEMBLY

(76) Inventors: Omar A. Ba-Akeel, Los Angeles, CA (US); Shahrzad Ghaemi, Los Angeles, CA (US)

( * ) Notice: Subject to any disclaimer, the term of this patent is extended or adjusted under 35 U.S.C. 154(b) by 447 days.

(21) Appl. No.: 12/238,670

(22) Filed: Sep. 26, 2008

(51) Int. Cl.
*A46B 13/02* (2006.01)
*A47K 17/02* (2006.01)

(52) U.S. Cl. ..... 15/56; 15/21.1; 15/246

(58) Field of Classification Search ..... 15/21.1, 15/56, 57, 246
See application file for complete search history.

(56) References Cited

U.S. PATENT DOCUMENTS

| | | | | |
|---|---|---|---|---|
| 609,285 | A * | 8/1898 | Lundgren | 15/56 |
| 1,539,718 | A * | 5/1925 | Crum | 15/56 |
| 4,092,744 | A * | 6/1978 | Butoi | 4/447 |
| 4,217,671 | A * | 8/1980 | Rand | 15/24 |
| 4,353,144 | A * | 10/1982 | Mayberry | 15/246 |
| 4,397,056 | A | 8/1983 | Miller | |
| D367,174 | S | 2/1996 | Matossian | |
| D404,924 | S | 2/1999 | Schmidt | |
| 5,984,555 | A | 11/1999 | Samad | |
| 6,295,681 | B1 | 10/2001 | Dolah | |
| 6,623,201 | B2 | 9/2003 | Brumlik | |
| 6,880,197 | B2 | 4/2005 | Katz et al. | |
| 6,966,720 | B2 | 11/2005 | Moss | |
| 7,131,783 | B1 | 11/2006 | DeRoma | |
| 2009/0044322 | A1 * | 2/2009 | Nunez et al. | 4/223 |

FOREIGN PATENT DOCUMENTS

| | | | |
|---|---|---|---|
| JP | 2002-129627 | * | 5/2002 |

* cited by examiner

*Primary Examiner* — Randall Chin

(57) ABSTRACT

A toilet bowl cleaning assembly includes an elongated housing that has a first end and a second end. A cleaning brush apparatus is rotatably coupled to the housing and extends downwardly from the second end of the housing. A drive apparatus is mounted in the housing and is mechanically coupled to the cleaning brush apparatus and turns the cleaning brush apparatus when the drive apparatus is turned on. A shroud is coupled to the housing between the first end of the housing and the cleaning brush apparatus. The shroud has a bottom edge is engageable with an upper edge of a toilet bowl. The cleaning brush apparatus is placed in the toilet bowl and the drive apparatus turned on to clean the toilet bowl.

9 Claims, 7 Drawing Sheets

TOILET BOWL CLEANING ASSEMBLY

BACKGROUND OF THE INVENTION

1. Field of the Invention

The present invention relates to toilet bowl cleaning devices and more particularly pertains to a new toilet bowl cleaning device for positioning in a toilet bowl so that the toilet bowl is cleaned automatically by the device.

2. Summary of the Invention

The present invention meets the needs presented above by generally comprising an elongated housing that has a first end and a second end. A cleaning brush apparatus is rotatably coupled to the housing and extends downwardly from the second end of the housing. A drive apparatus is mounted in the housing and is mechanically coupled to the cleaning brush apparatus and turns the cleaning brush apparatus when the drive apparatus is turned on. A shroud is coupled to the housing between the first end of the housing and the cleaning brush apparatus. The shroud has a bottom edge is engageable with an upper edge of a toilet bowl. The cleaning brush apparatus is placed in the toilet bowl and the drive apparatus turned on to clean the toilet bowl.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
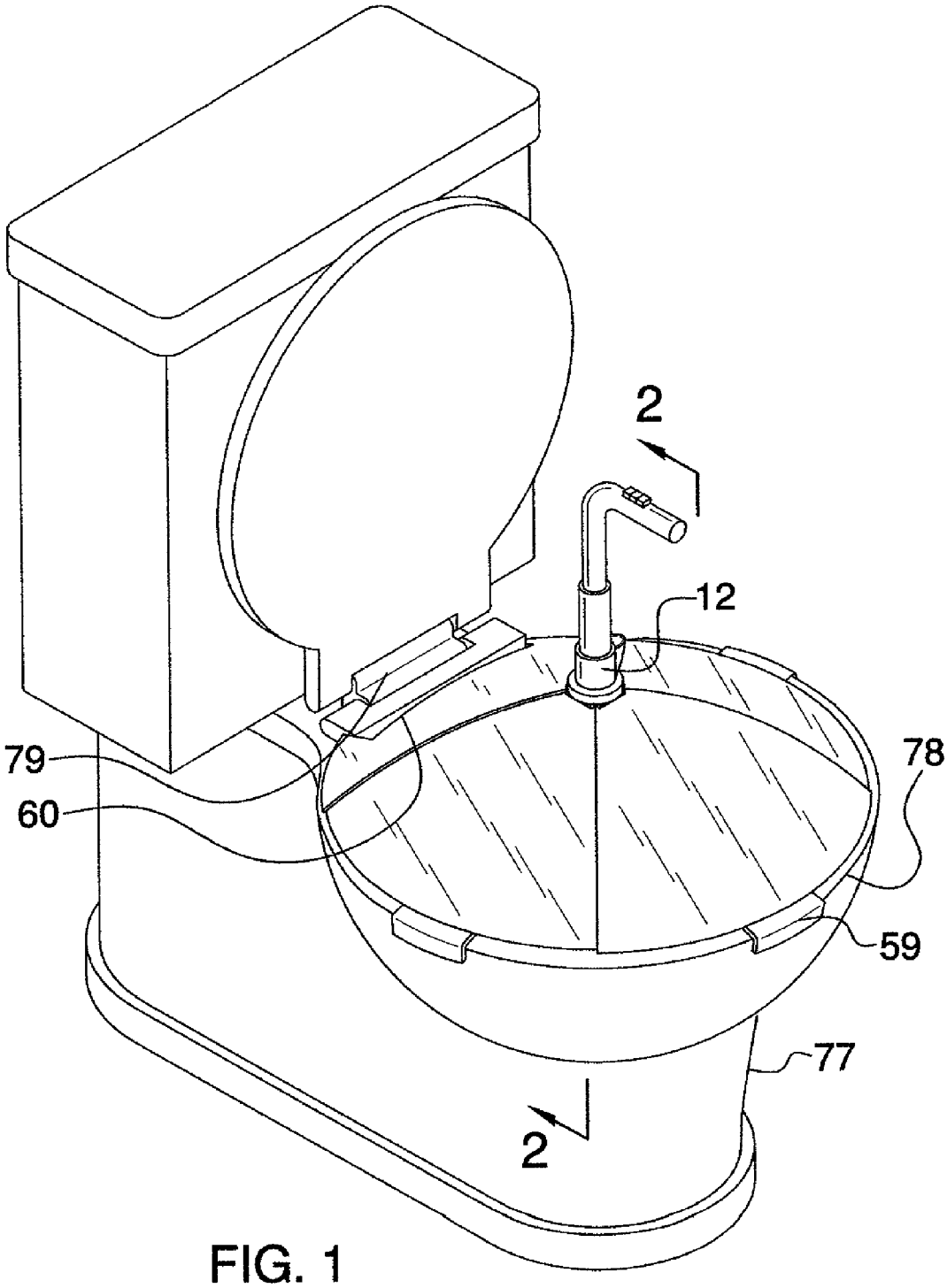
FIG. 1 is an in-use top perspective view of a toilet bowl cleaning assembly according to the present invention.
Figure 2:
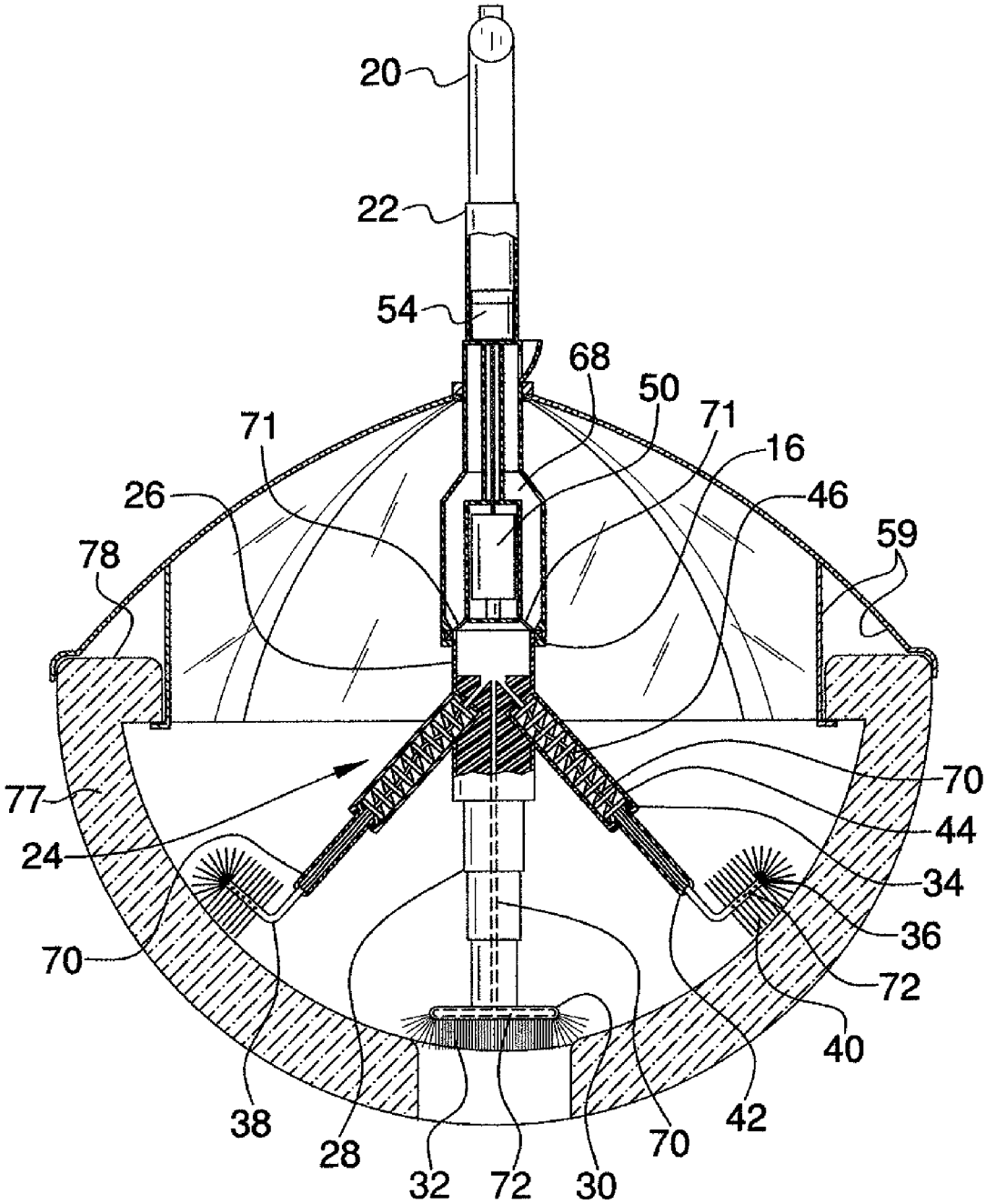
FIG. 2 is a cross-sectional view taken along line 2-2 of FIG. 1 of the present invention.
Figure 3:
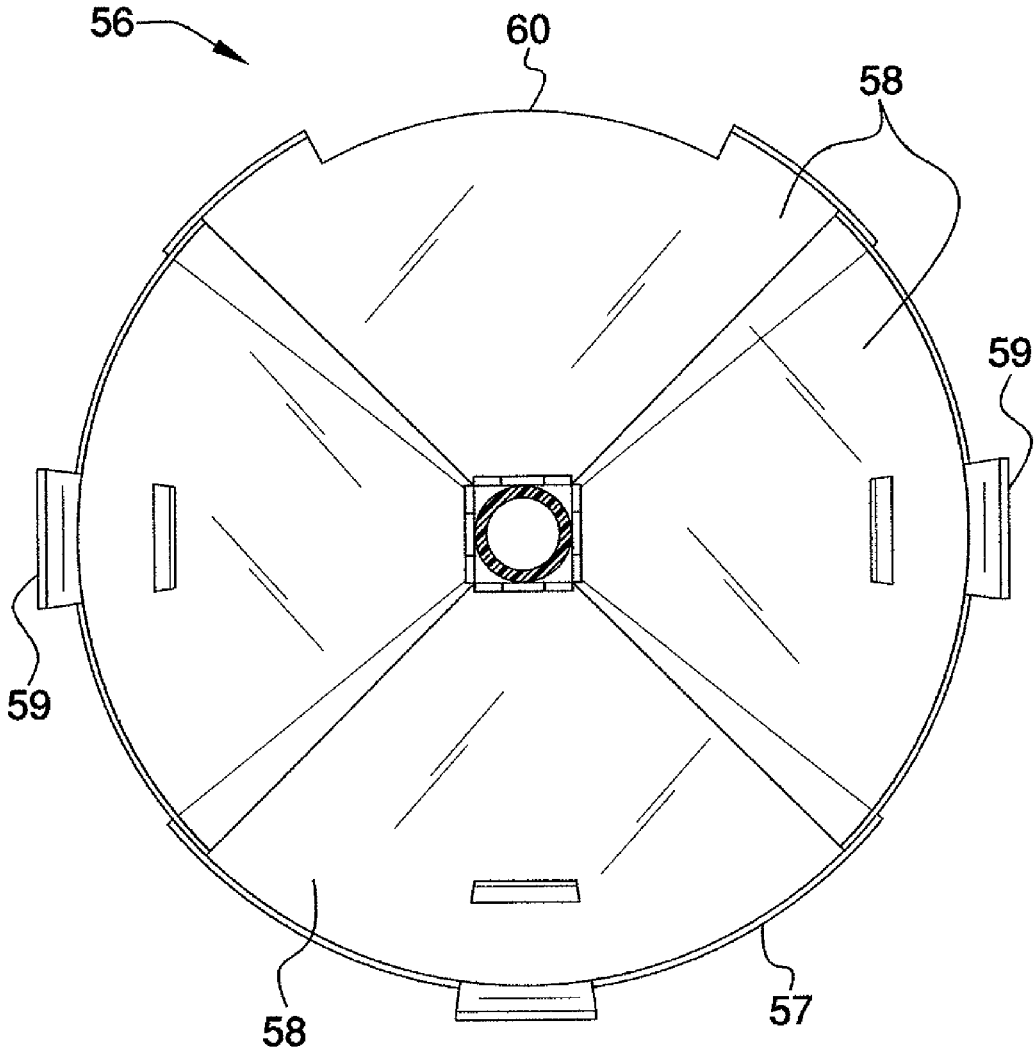
FIG. 3 is a bottom view of a shroud of the present invention.
Figure 4:
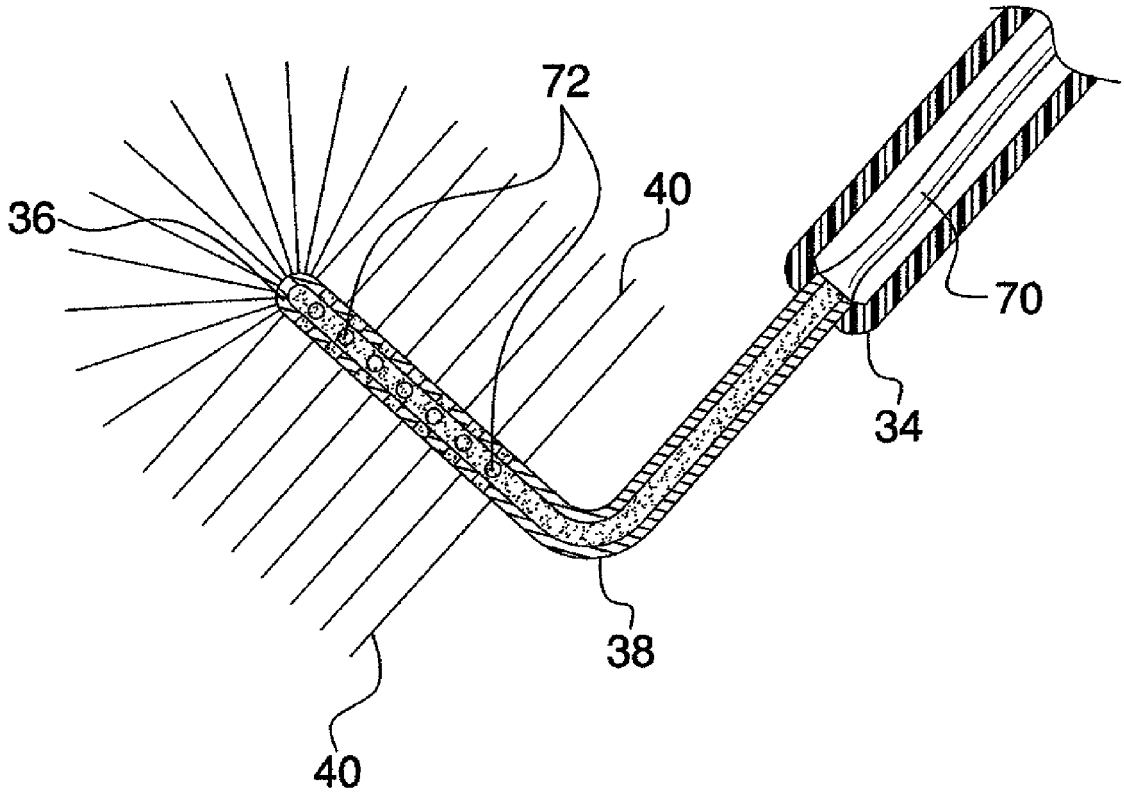
FIG. 4 is an enlarged side cross-sectional view of a lateral shaft of the present invention.
Figure 5:
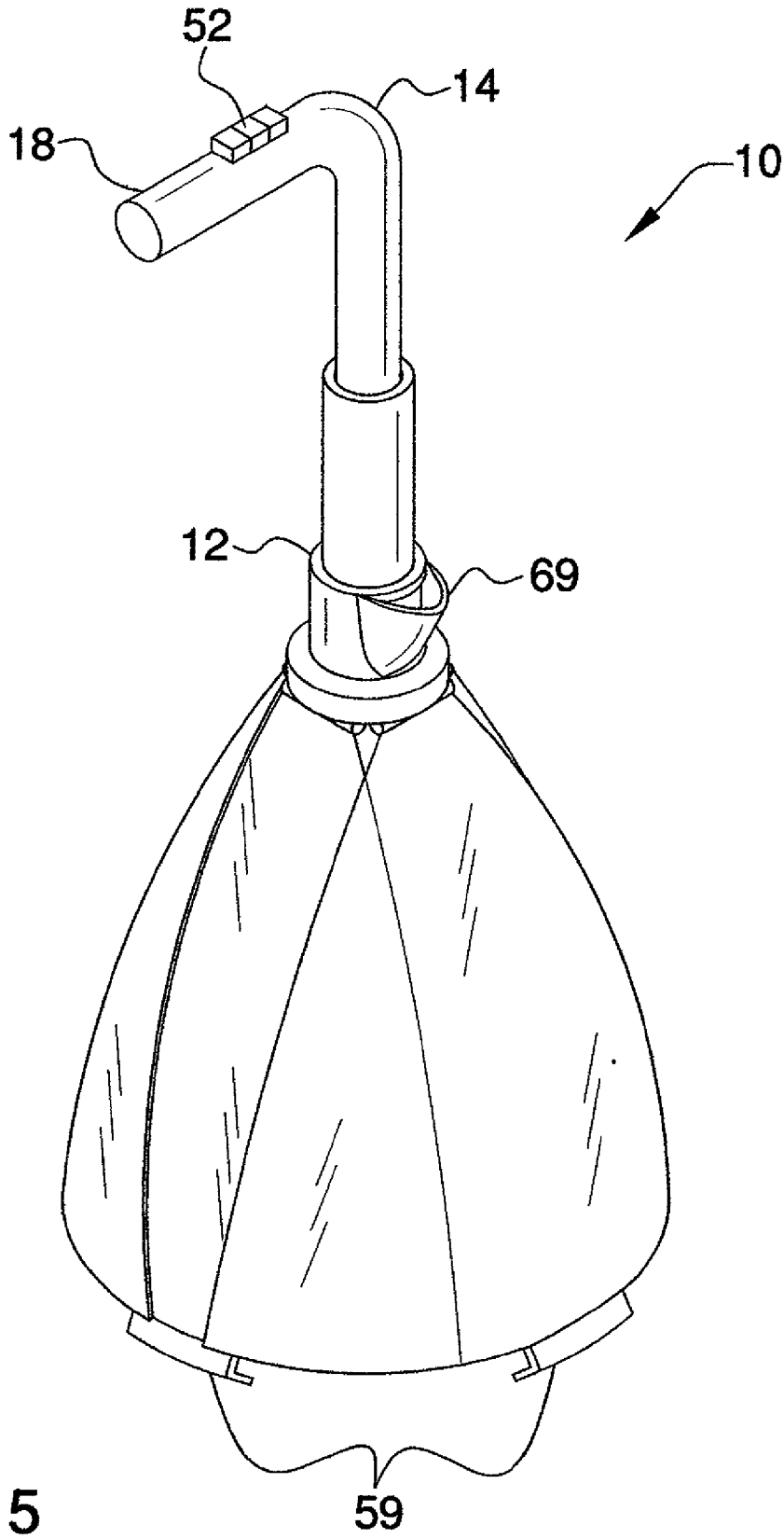
FIG. 5 is a top perspective view of the present invention.
Figure 6:
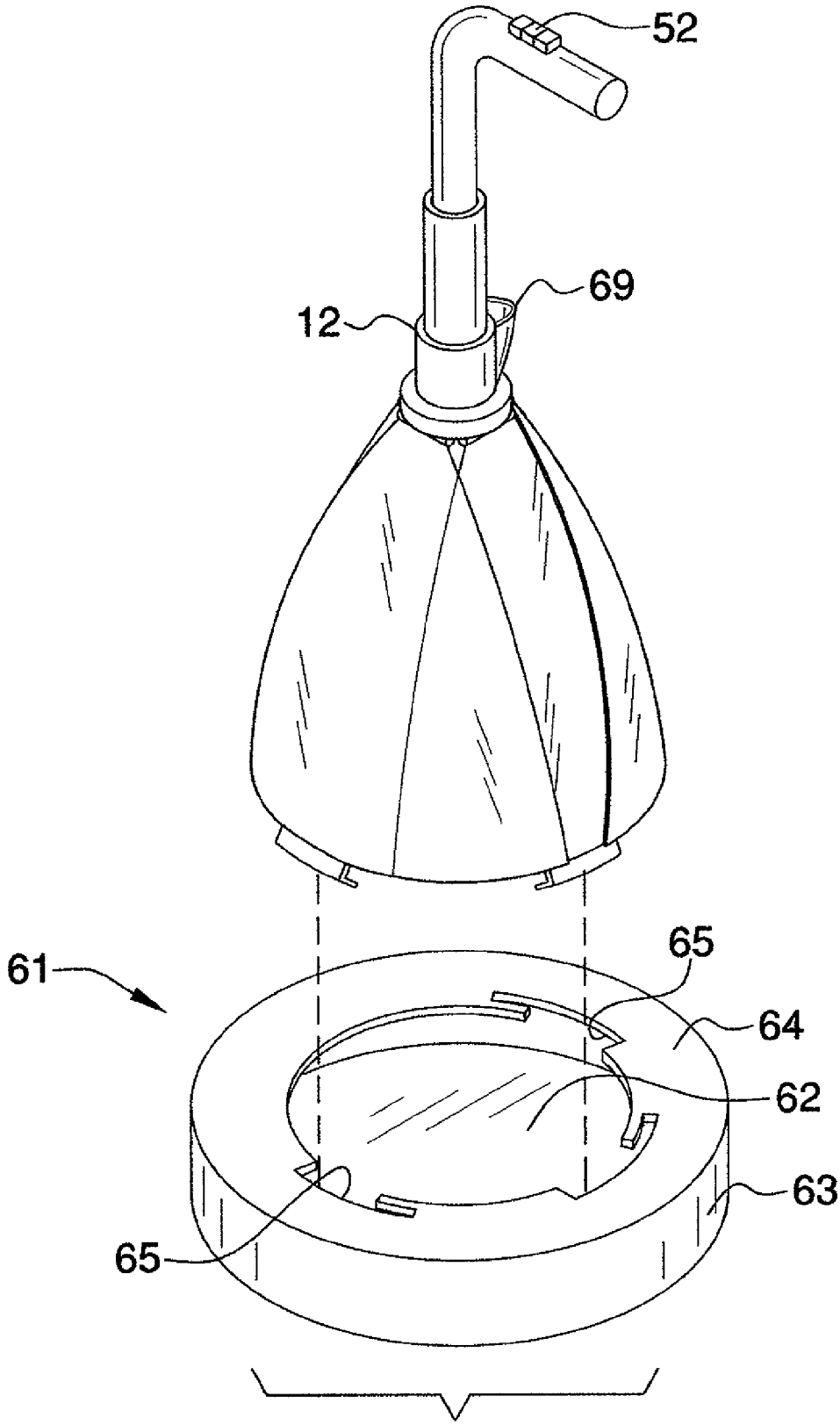
FIG. 6 is a top perspective view of the present invention.
Figure 7:
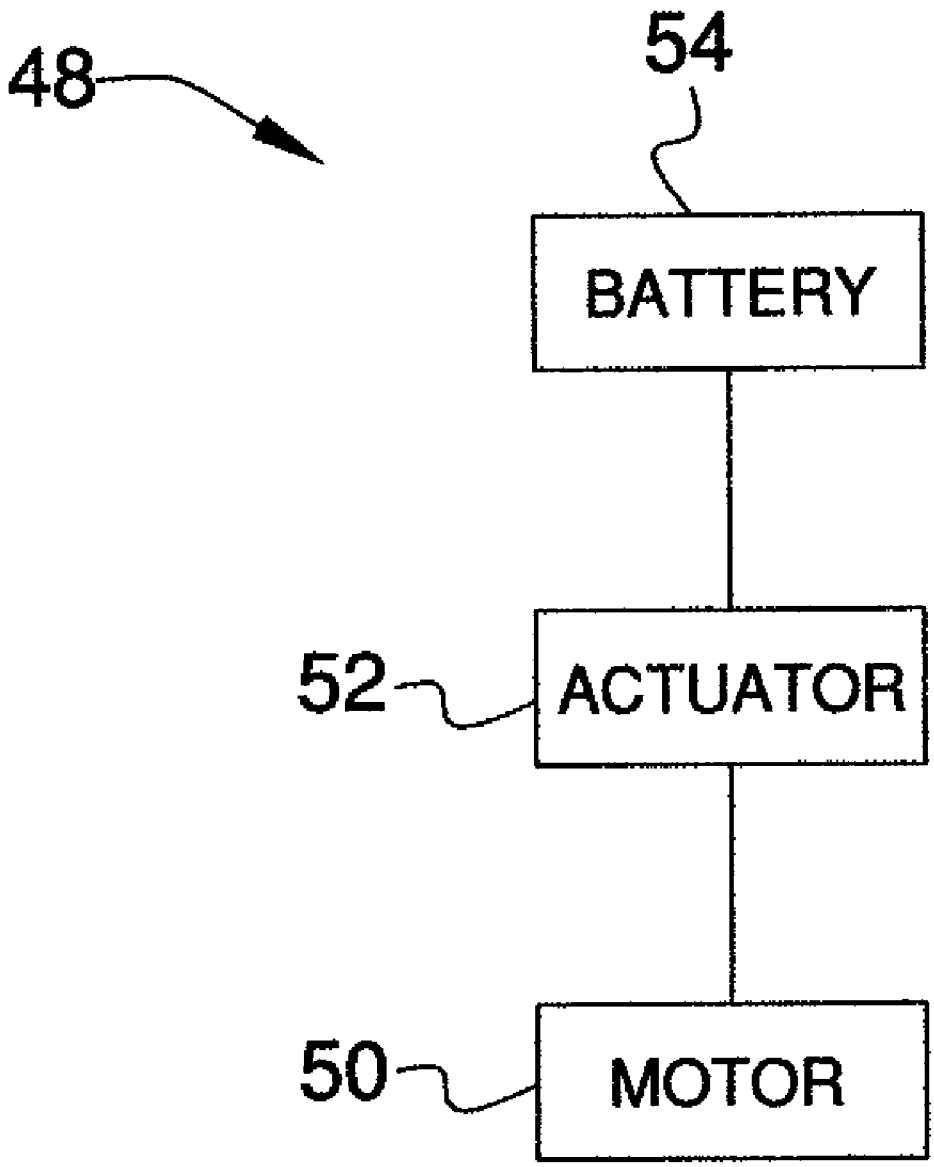
FIG. 7 is a schematic view of the present invention.

With reference now to the drawings, and in particular to FIGS. 1 through 7 thereof, a new toilet bowl cleaning device embodying the principles and concepts of the present invention and generally designated by the reference numeral 10 will be described.

As best illustrated in FIGS. 1 through 7, the toilet bowl cleaning assembly 10 generally comprises an elongated housing 12 that has a first end 14 and a second end 16. The grip 18 is attached to the second end 14 of the housing 12. The housing 12 is telescopic and has a first section 20 extendable outwardly of a second section 22 to adjust a height of the housing 12.

A cleaning brush apparatus 24 is rotatably coupled to the housing 12 and extends downwardly from the second end 16 of the housing 12. The cleaning brush apparatus 24 includes a central mount 26 that is rotatably coupled to the second end 16. A central shaft 28 is attached to and extends downwardly from the central mount 26. The central shaft 28 has a bottom end comprising a cleaning head 30. The cleaning head 30 includes a plurality of bristles 32 extending downwardly and outwardly from the central shaft 28. The central shaft 26 is aligned with the housing 12 and is telescopic.

The cleaning brush apparatus 24 further includes a pair of lateral shafts 34 attached to and extending outwardly and downwardly from the central mount 26. An angle between the lateral shafts 34 and the central shaft 28 is between 20 degrees and 60 degrees. The central shaft 28 extends vertically downward further from the housing 12 than the lateral shafts 34. Each of the lateral shafts 34 has a distal end 36 with respect to the central mount 26. The lateral shafts 34 each have a bend 38 therein positioned nearer to the distal end 36 than the central mount 26. The bend 38 forms an angle between 70 degrees and 110 degrees. A plurality of bristles 40 is attached to each of the lateral shafts 34. The bristles 40 on the lateral shafts 34 are positioned between corresponding ones of the distal ends 36 and the bends 38. The lateral shafts 34 are telescopic and include a first portion 42 slidably extendable outwardly of a second portion 44. Each of the lateral shafts 34 includes a biasing member 46 biasing the first portions 42 outwardly of an associated one of the second portions 44.

A drive apparatus 48 is mounted in the housing 12. The drive apparatus 48 is mechanically coupled to the cleaning brush apparatus 24 and includes a motor 50 mounted in the housing 12 that is coupled to the central mount 26. An actuator 52 is mounted on the grip 18 and is electrically coupled to the motor 50. The motor 50 rotates the central mount 26 when the actuator 52 is moved to an on position. A battery 54 is mounted within the housing 12 to supply electrical power to the motor 50.

A shroud 56 is coupled to the housing 12 between the first end 14 of the housing 12 and the cleaning brush apparatus 24. The shroud 56 has a bottom edge 57 that is engageable with an upper edge 78 of a toilet bowl 77. The shroud 56 includes a plurality of panels 58 hingedly coupled to the housing 12. The panels 58 are expandable outwardly from the housing 12 to increase a diameter of the bottom edge 57 of the shroud 56. A plurality of clip members 59 is attached to the shroud 56 adjacent to the bottom edge 57. The clip members 59 are releasably engageable to the upper edge 78 of the toilet bowl 77. The bottom edge 57 has a notch 60 therein for receiving a hinge 79 of a toilet seat mounted on the toilet bowl 77. A receiving base 61 includes a bottom wall 62 and a perimeter wall 63 being attached to and extending upwardly from the bottom wall 62. An inwardly extending perimeter flange 64 is attached to the perimeter wall 63. The flange 64 includes a plurality of notches 65 for receiving the clip members 59 to retain the shroud 56 in a closed position and to support the assembly 10 in a vertical orientation as can appreciated from FIG. 6.

A fluid chamber 68 is positioned within the housing 12 and is fluidly coupled with the cleaning brush apparatus 24. A cleaning solution is positionable in the fluid chamber 68 to supply cleaning solution to the cleaning brush apparatus 24. The housing 12 includes, a fill aperture 69 fluidly coupled to the fluid chamber 68 to fill the fluid chamber 68 with the cleaning solution. A plurality of conduits 70 is fluidly coupled to the fluid chamber 68. In particular, the central mount 26 includes inlet apertures 71 to receive fluid from the fill fluid chamber 68 and the conduits 70 are fluidly coupled to the central mount 26. Each of the conduits 70 is fluidly coupled to one of the central 28 and lateral 34 shafts to provide fluid from the fluid chamber 68 to each of the lateral 34 and central 28 shafts. The fluid is ejected outwardly through outlet apertures 72 in the central 28 and lateral shafts 34.

In use, the cleaning brush apparatus 24 is placed in the toilet bowl 77 and the drive apparatus 48 turned on to clean the toilet bowl 77. When the drive apparatus 48 is turned on, the centrifugal force caused by the rotation of the lateral shafts 34 along with gravity causes the cleaning solution to be ejected by the brush apparatus 24 onto the toilet bowl 77 while the bristles 32, 40 on the central 28 and lateral 34 shafts clean the toilet bowl 77.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A toilet bowl cleaning assembly comprising:

an elongated housing having a first end and a second end;

a cleaning brush apparatus being rotatably coupled to said housing and extending downwardly from said second end of said housing, wherein said cleaning brush apparatus includes;

a central mount being rotatably coupled to said second end;

a central shaft being attached to and extending downwardly from said central mount, said central shaft having a bottom end comprising a cleaning head, said cleaning head including a plurality of bristles extending downwardly and outwardly from said central shaft; and a pair of lateral shafts being attached to and extending outwardly and downwardly from said central mount, an angle between said lateral shafts and said central shaft being between 20 degrees and 60 degrees, each of said lateral shafts having a distal end with respect to said central mount, each of said lateral shafts having a therein positioned nearer to said distal end than said central mount, said bend forming an angle between 70 degrees and 110 degrees, a plurality of bristles being attached to each of said lateral shafts, said bristles on said lateral shafts being positioned between corresponding ones of said distal ends and said bends, said lateral shafts being telescopic and including a first portion slidably extendable outwardly of a second portion, each of said lateral shafts including a biasing member biasing said first portions outwardly of an associated one of said second portions, said central shaft being aligned with said housing, said central shaft being telescopic;

a drive apparatus being mounted in said housing, said drive apparatus being mechanically coupled to said cleaning brush apparatus and turning said cleaning brush apparatus when said drive apparatus is turned on;

a shroud being coupled to said housing between said first end of said housing and said cleaning brush apparatus, said shroud having a bottom edge being engageable with an upper edge of a toilet bowl; and wherein the cleaning brush apparatus is placed in the toilet bowl and the drive apparatus turned on to clean the toilet bowl.

2. The assembly according to claim 1, wherein a grip is attached to said first end of said housing, said housing being telescopic and having a first section extendable outwardly of a second section.

3. The assembly according to claim 1, wherein said drive apparatus includes a motor mounted in said housing and coupled to said central mount, an actuator being electrically coupled to said motor, said motor rotating said central mount when said actuator is moved to an on position.

4. The assembly according to claim 1, wherein said shroud includes a plurality of panels hingedly coupled to said housing and being expandable outwardly from said housing to increase a diameter of said bottom edge of said shroud.

5. The assembly according to claim 4, further including a plurality of clip members being attached to said shroud adjacent to said bottom edge, said clip members being releasably engageable to the upper edge of the toilet bowl.

6. The assembly according to claim 4, wherein said bottom edge has a notch therein for receiving a hinge of a toilet seat mounted on the toilet bowl.

7. The assembly according to claim 1, further including a fluid chamber being positioned within said housing and being fluidly coupled with said cleaning brush apparatus, wherein a cleaning solution is positionable in said fluid chamber.

8. The assembly according to claim 7, wherein said housing includes a fill aperture fluidly coupled to said fluid chamber, a plurality of conduits being fluidly coupled to said fluid chamber, each of said conduits being fluidly coupled to one of said central and lateral shafts to provide fluid from said fluid chamber to each of said lateral and central shafts.

9. A toilet bowl cleaning assembly comprising:

an elongated housing having a first end and a second end, a grip being attached to said end of said housing, said housing being telescopic and having a first section extendable outwardly of a second section;

a cleaning brush apparatus being rotatably coupled to said housing and extending downwardly from said second end of said housing, said cleaning brush apparatus including;

a central mount being rotatably coupled to said second end;

a central shaft being attached to and extending downwardly from said central mount, said central shaft having a bottom end comprising a cleaning head, said cleaning head including a plurality of bristles extending downwardly and outwardly from said central shaft, said central shaft being aligned with said housing, said central shaft being telescopic;

a pair of lateral shafts being attached to and extending outwardly and downwardly from said central mount, an angle between said lateral shafts and said central shaft being between 20 degrees and 60 degrees, each of said lateral shafts having a distal end with respect to said central mount, each of said lateral shafts having a bend therein positioned nearer to said distal end than said central mount, said bend forming an angle between 70 degrees and 110 degrees, a plurality of bristles being attached to each of said lateral shafts, said bristles on said lateral shafts being positioned between corresponding ones of said distal ends and said bends, said lateral shafts being telescopic and including a first portion slidably extendable outwardly of a second portion, each of said lateral shafts including a biasing member biasing said first portions outwardly of an associated one of said second portions;

a drive apparatus being mounted in said housing, said drive apparatus being mechanically coupled to said cleaning brush apparatus, said drive apparatus including a motor mounted in said housing and coupled to said central mount, an actuator being electrically coupled to said motor, said motor rotating said central mount when said actuator is moved to an on position;

a shroud being coupled to said housing between said first end of said housing and said cleaning brush apparatus, said shroud having a bottom edge being engageable with an upper edge of a toilet bowl, said shroud including a plurality of panels hingedly coupled to said housing and being expandable outwardly from said housing to increase a diameter of said bottom edge of said shroud, a plurality of clip members being attached to said shroud adjacent to said bottom edge, said clip members being releasably engageable to the upper edge of the toilet bowl, said bottom edge having a notch therein for receiving a hinge of a toilet seat mounted on the toilet bowl;

a fluid chamber being positioned within said housing and being fluidly coupled with said cleaning brush apparatus, wherein a cleaning solution is positionable in said fluid chamber, said housing including a fill aperture fluidly coupled to said fluid chamber, a plurality of conduits being fluidly coupled to said fluid chamber, each of said conduits being fluidly coupled to one of said central and lateral shafts to provide fluid from said fluid chamber to each of said lateral and central shafts; and wherein the cleaning brush apparatus is placed in the toilet bowl and the drive apparatus turned on to clean the toilet bowl.

* * * * *